US005965207A

United States Patent [19]

Kropfeld et al.

[11] Patent Number: 5,965,207

[45] Date of Patent: Oct. 12, 1999

[54] METHOD OF APPLYING A POLYURETHANE COATING ON ENGINEERED PARTICLEBOARDS

[75] Inventors: Scott A. Kropfeld, Lapeer; Russell L. Cole, Ortonville, both of Mich.

[73] Assignee: Illinois Tool Works, Inc., Glenview, Ill.

[21] Appl. No.: 09/073,584

[22] Filed: May 6, 1998

[51] Int. Cl.[6] ..... B05D 1/38; B05D 3/08; B05D 3/12; B05D 3/02

[52] U.S. Cl. ..... 427/403; 427/317; 427/291; 427/371; 427/382; 427/408; 427/224

[58] Field of Search ..... 427/403, 408, 427/223, 224, 317, 371, 382, 291

[56] References Cited

U.S. PATENT DOCUMENTS

| | | | |
|---|---|---|---|
| 2,086,862 | 7/1937 | Fletcher | 427/403 |
| 2,644,771 | 7/1953 | Kempthorne | 427/403 |
| 2,902,388 | 9/1959 | Szukiewcz | 427/403 |
| 3,880,687 | 4/1975 | Elmendorf et al. | 156/62.2 |
| 3,941,632 | 3/1976 | Swedenberg et al. | 427/407.1 |
| 3,991,252 | 11/1976 | Kolakowski et al. | 427/407.1 |
| 4,177,232 | 12/1979 | Day | 427/403 |
| 4,315,967 | 2/1982 | Prior et al. | 428/285 |
| 4,435,472 | 3/1984 | Leah | 427/407.1 |
| 4,559,241 | 12/1985 | Obitsu et al. | 427/407.1 |
| 5,026,576 | 6/1991 | Benvenuto et al. | 427/403 |
| 5,344,490 | 9/1994 | Roosen et al. | 106/778 |
| 5,635,248 | 6/1997 | Hsu et al. | 427/393 |
| 5,842,276 | 12/1998 | Asher et al. | 29/897.32 |

*Primary Examiner*—Diana Dudash
*Attorney, Agent, or Firm*—Howard & Howard

[57] ABSTRACT

A method of applying a smooth thin waterproof coating on engineered particleboards including oriented strand boards, thereby permitting the use of such boards for applications wherein the boards are exposed to moisture, including, for example, foundation forms, roof sheathing, basement walls, etc. The method of this invention includes applying a thin liquid cementitious coating on a surface of an engineered particleboard having a moisture content preferably less than three percent, wherein the cementitious coating fills the interstices between the particles and coats the surface. The cementitious coating is then dried and the surface is abraded to receive a thin liquid curable polyurethane coating over the cementitious coating. Finally, the exposed surface of the polyurethane coating is heated to remove surface imperfections and cure the polyurethane coating. In the preferred method, the liquid polyurethane coating is heated and cured by applying an open flame to the surface of the liquid polyurethane coating which removes surface imperfections, such as bubbles, and simultaneously cures the coating.

20 Claims, 1 Drawing Sheet

20
30
24
28
22
26
24

50
56
POLYURETHANE
GAS
62
58
52
B
48
54
44
46
60
47

42
53
30
38
CEMENT
40
28
34
34
34
32
22
28
30
20
22
34
A 23
32
20C
CEMENT
38
20A
20B
66
34
40
22

METHOD OF APPLYING A POLYURETHANE COATING ON ENGINEERED PARTICLEBOARDS

FIELD OF THE INVENTION

This invention relates to a method of forming a thin smooth waterproof polyurethane coating on a surface of an engineered particleboard, particularly including an oriented strand board, which is firmly bonded to the particleboard. The polyurethane coating method of this invention may be used as a final step in the manufacturer of engineered particleboards, including oriented strand boards, wherein the moisture content of the boards is less than about three percent or the boards may be heated and dried as an initial step in the method of this invention.

BACKGROUND OF THE INVENTION

As will be understood by those skilled in the art, engineered particleboards including oriented strand boards or "OSB" boards are less expensive than solid wood boards and wood laminates, strong and light in weight. However, such particleboards are limited in their application and use by the construction industry, for example, because engineered particleboards are strongly hydrophilic. When exposed to water or moisture, for a period time, the average moisture content of OSB boards, for example, increases to about twenty percent. When manufactured, however, OSB boards have a moisture content of less than about two to three percent. Thus, particleboards such as OSB boards generally cannot be used for such applications as building foundation forms, roof sheathing, basement walls, etc. OSB boards for example include relatively large wood particles, strands or chips in a resin matrix or binder. The exposed surfaces of engineered particleboards are also relatively rough and include spaces or interstices between the particles which must be filled if the exposed surfaces are coated with a smooth waterproof coating, particularly where the coating is relatively thin, such as a coating having a thickness of about 0.020 inches.

Engineered particleboards, such as OSB boards, comprise particles of wood or wood-based products, such as paper, in a resin matrix or binder, wherein the particles are oriented to provide strength and rigidity to the boards. Generally, the preferred binder is methylene bis phenylisocyanate or methylene diphenyl isocyanate (MDI) which is applied to the particles or wood chips by spraying the liquid binder into a blender. In the manufacture of oriented strandboards, for example, debarked logs are cut into strands or wafers which are dried with heat and screened to grade for strands of the correct size. The dried strands are then coated with a binder such as MDI and transported in layers on a conveyor to a forming line, where the layers are cross-oriented into mats. For face layers, the strands generally run along the panel while the core layers are randomly oriented or run across the panel. The mats are trimmed to a workable size and then transported to a press where the wood strands and glue are bonded under heat and pressure to create a structural panel.

Engineered particleboards such as oriented strand boards may be covered, for example, by adhesively bonding a plastic sheet over the surfaces of the boards; however, this method is relatively expensive and thus eliminates the cost advantage of such boards. The applicants have also determined that oriented strand boards for example may be coated directly with a polyurea coating. However, the polyurea coating must be relatively thick (greater than about 0.040 inches) and polyurea coating polymers are relatively expensive. Further, it was determined by the applicants that conventional methods may not be used to coat particleboards such as oriented strand boards with polyurethane because of the high moisture content of OSB boards and because the polyurethane coated surface has numerous surface imperfections including pin holes, bubbles, etc. Further, the relatively large wood particles and the interstices between the particles will "read" through the polyurethane coating. That is, the exposed surface of a relatively thin polyurethane coating having a thickness, for example, of 0.020 inches will conform to the wood particles and interstices between the particles making the polyurethane coated boards unacceptable for certain applications. As will be understood by those skilled in the art, the hydroxyl component of polyurethane will react with water and therefore it is generally not possible to coat a panel having a relatively high moisture content of greater than about five percent.

Thus, there has been a longfelt need for a relatively inexpensive method of coating engineered particleboards such as oriented strand boards, particularly a coating that is waterproof and relatively smooth. It is also important in certain applications such as building foundation forms to use panels or boards which are relatively free of surface imperfections, such that the surface imperfections are not imprinted on the poured foundation. Pin holes which expose the particleboards to moisture must also be avoided in roof sheathing, for example, and other applications where the boards or panels are exposed to moisture. Therefore, such applications are now limited to solid wood panels or laminates which are less hydrophilic. The method of forming a polyurethane coating on engineered particleboards such as oriented strand boards of this invention solves the above problems by providing a thin smooth waterproof coating which is relatively inexpensive, particularly when compared to other polymer coatings such as polyurea. Further, the polyurethane coating method of this invention may be utilized as a final step in the manufacturer of engineered particleboards or may be used to coat such boards at a separate facility.

SUMMARY OF THE INVENTION

As set forth above, the method of this invention is particularly adapted for forming a smooth polyurethane coating on a surface of an engineered particleboard, such as oriented strand board, or other particleboard having particles or wood chips in a resin matrix. In a typical engineered particleboard, the surfaces of the board are relatively rough and include spaces or interstices between the particles. The polyurethane coating method of this invention may be used on OSB boards for example received directly from the manufacturing process or mill wherein the boards have an average moisture content of less than five percent or more preferably less than about two to three percent and wherein the boards are heated. Alternatively, where the particleboards have been exposed to moisture over a period of time, the boards are first heated and dried by a radiant heater, for example, such that the average moisture content is reduced to less than about five percent or more preferably less than about two to three percent.

Thus, the first step in the method of this invention is to apply a thin liquid cementitious coating on one or more surfaces of a particleboard having a moisture content of less than about five percent or more preferably less than two to three percent. The liquid cementitious coating may be applied by any suitable manner, including, for example, a roller saturated with the liquid cementitious coating material or a conventional dam which applies a thin coating of the liquid cementitious material. The liquid cementitious coating fills the spaces or interstices between the particles or wood chips and coats the surface of the particleboard. A suitable thickness for the coating over the wood particles is between about 0.001 to 0.010 inches, or greater, although the thickness of the coating is not important provided the cementitious coating fills the spaces or interstices between the wood particles or chips and provides a relatively smooth surface for application of the polyurethane coating. In the preferred method of this invention, the thickness of the cementitious coating is just sufficient to fill the interstices or spaces between the wood particles to provide a relatively smooth surface to receive the polyurethane coating. A suitable cementitious coating is refined portland cement suspended in water; however, the moisture content of the cementitious coating is preferably relatively low to reduce the time required for drying the first coating. The cementitious coating is then dried by any suitable means including air drying which may be facilitated by warm or hot recirculating air. The cementitious coated particleboard may also be dried and heated in a recirculating conveyor oven for example.

The exposed surface of the cementitious coating is then slightly abraded to level the surface and provide a mechanical bond for the later polyurethane coating and prevent reading of the surface of the particleboard through the relatively thin polyurethane coating. The surface of the cementitious coating may be abraded by any suitable means including, for example, a belt sander, an abrasion roller or the like.

A relatively thin polyurethane coating is then applied over the abraded cementitious coating. As set forth above, one of the advantages of the polyurethane coating method of this invention is that the polyurethane coating may be relatively thin while providing a smooth waterproof coating for particleboards, such as oriented strand boards, thereby reducing the cost of the coated board. The thickness of the polyurethane coating may be as thin as about 0.020 inches or less while providing a smooth waterproof coating. The thickness of the polyurethane coating may, however, range from about 0.010 inches to 0.040 inches or greater, although the cost of the polyurethane coated particleboard will depend in part upon the thickness of the coating and therefore the most preferred range is between about 0.15 inches and 0.030 inches. The most preferred polyurethane coating is a relatively slow cure polyurethane having a cure time of between about five to eight minutes tack free at ambient temperatures. A suitable plural component polyurethane coating material is available from ITW Foamseal of Oxford, Mich. under the tradename "V8101."

The final step of the preferred embodiment of the polyurethane coating method of this invention is to heat the exposed surface of the polyurethane coating, thereby flattening and removing surface imperfections in the coating and simultaneously curing the polyurethane coating. A preferred method of applying the coating is to spray the coating over the abraded cementitious coating using a conventional spray apparatus available from ITW Foamseal. The polyurethane coating may also be poured over the cementitious coating using an applicator having a static mixer and a plurality of nozzles, for example, and the coating may be leveled with a knife. As will be understood, however, by those skilled in the art, a conventional polyurethane coating, particularly a relatively thin coating, will have surface imperfections including, for example, bubbles and pin holes, particularly when sprayed. If the sprayed polyurethane coating is then allowed to cure under normal atmospheric conditions, the surface imperfections will prevent the use of the polyurethane coated particleboard in many applications. As set forth above, an object of the polyurethane coating method of this invention is to provide a relatively smooth waterproof coating on particleboards including oriented strand boards and similar engineered particleboards. For example, where the coated particleboard is used for building foundation forms, the surface imperfections in the coating will be applied to the building foundation. More importantly, where the polyurethane coating includes pin holes or small interstices which expose the particleboard to the atmosphere, the polyurethane coated boards would be unsuitable for roof sheathing or roof panels, foundation forms, etc.

In the most preferred embodiment of this invention, the surface of the polyurethane coating is heated preferably by applying an open flame to the surface of the polyurethane coating, thereby removing the surface imperfections in the coating and simultaneously curing the coating in about fifteen to thirty seconds. The reason why an open flame applied to the surface of the liquid polyurethane coating removes the surface imperfections is not fully understood. It is believed however that bubbles are maintained on the surface because of the surface tension on the liquid polyurethane coating. Thus, heating of the surface particularly with an open flame having a temperature of about 1200° F. may reduce the surface tension and improve the flowability of the liquid polyurethane coating, thereby filling the interstices and eliminating the bubbles. Another possibility is rapid surface heating by an open flame reduces the viscosity of the surface of the polyurethane coating, with the same result. Regardless of the precise mechanism, however, rapid heating of the surface of the liquid polyurethane coating, particularly by applying an open flame, results in flattening of the surface, removing the surface imperfections and simultaneously curing the coating. The term flattening or "flatting" as used by the paint industry is meant to define a smoothing of the coating without materially changing its thickness. It should be understood that prolonged exposure of the liquid polyurethane coating to an open flame will damage the coating and thus the flame is preferably swept across the coating, curing the coating and removing surface imperfections.

The resultant polyurethane coated oriented strand board or engineered particleboard formed by the method of this invention has a smooth relatively blemish-free surface and the polyurethane coating protects the board from moisture. As will be understood, one or both surfaces of the board may be coated with polyurethane by the method of this invention and the edges may be sealed as desired. The polyurethane coated oriented strand board may thus be used for many applications for which engineered particleboards, such oriented strand boards are presently excluded, including, for example, building foundation forms, roof sheathing and the like. Other advantages and meritorious features will be more fully understood from the following description of the preferred embodiments, the appended claims and the drawings, a brief description of which follows.

DESCRIPTION OF THE PREFERRED EMBODIMENTS

Figures 1, 2, 3, 4:
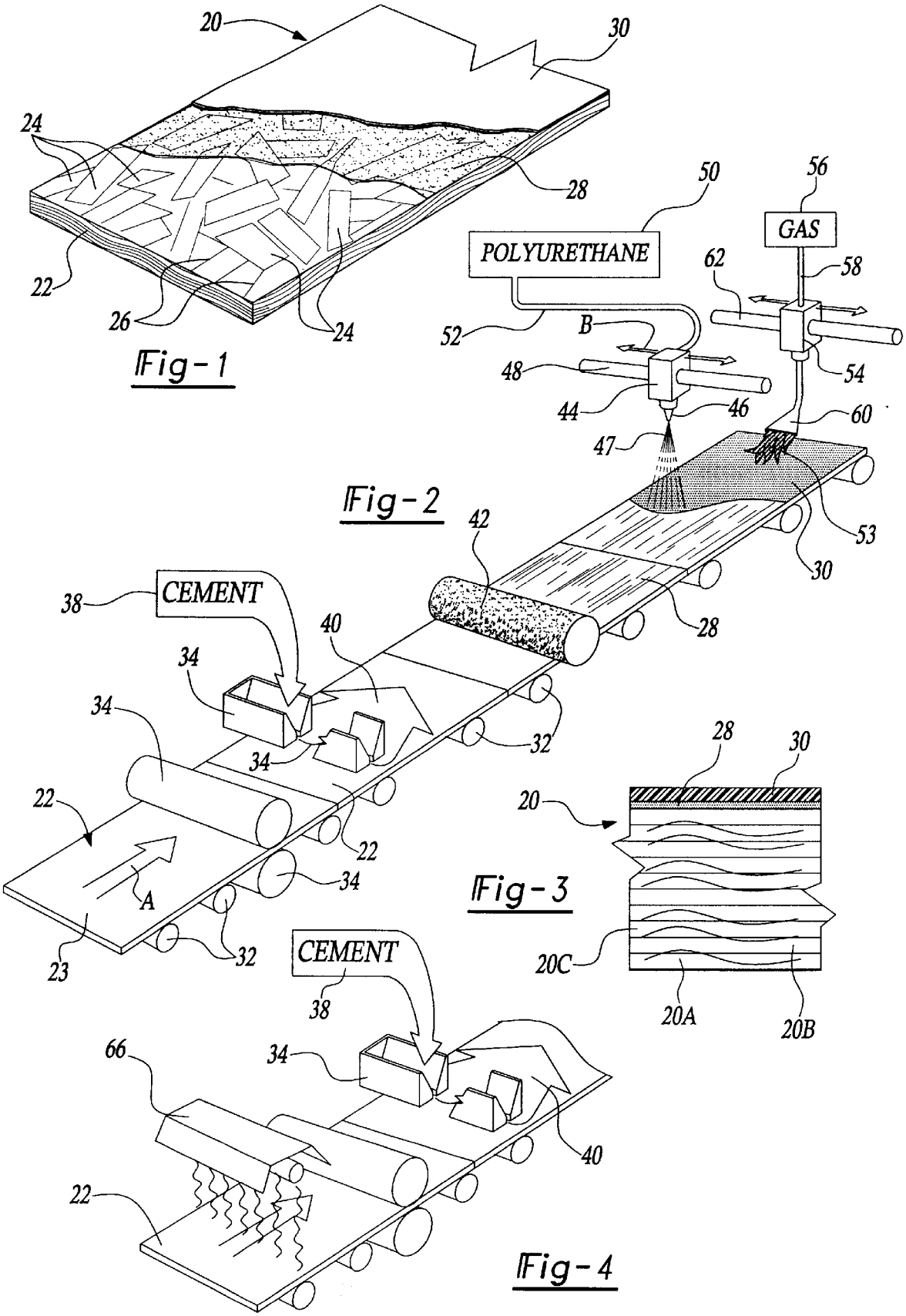
FIG. 1 is a side elevational view of an engineered particleboard such as an OSB board coated by the method of this invention with the coating layers broken away for descriptive purposes
FIG. 2 is a somewhat schematic top elevation of a continuous process utilizing the polyurethane coating method of this invention where the boards are received directly from the manufacture of the boards.
FIG. 3 is a cross-sectional view of a polyurethane coated board coated by the method of this invention.
FIG. 4 is a partial side elevation of the continuous polyurethane coating process shown in FIG. 2 where the boards are preheated and dried before coating.

FIG. 1 illustrates a polyurethane coated oriented strand board or the like 20 with the board 20 and the coating layers exposed for descriptive purposes. As described above, an oriented strand board 22 includes large wood particles, strands or chips 24 supported in a resin matrix or binder 26. The surface to be coated of the oriented strand board 22 is relatively rough because the wood particles 24 at the surface are rough and the surfaces of the strands are not completely co-planer. Further, there are spaces or interstices between the wood particles 24. Oriented strand boards are, however, used for subflooring and reinforcement in building construction because oriented strand boards are relatively inexpensive and strong. As set forth above, however, particleboards such as OSB boards are strongly hydrophilic and therefore unsuitable for many applications. As discussed more fully hereinbelow, the engineered particleboard is first coated with a cementitious coating 28, which is preferably abraded prior to receiving the polyurethane coating 30. Thus, the board 22 includes two coatings, including an abraded cementitious coating 28 and a smooth polyurethane coating 30.

FIG. 2 illustrates one preferred embodiment of a continuous manufacturing line utilizing the method of this invention. As set forth above, engineered particleboards, such as OSB boards, are generally manufactured in a mill, wherein the particles are coated with a resin or binder, such as an MDI-based binder and the composite is compressed and heated to cure the resin binder, such that the average moisture content of the particleboard is less than about two to three percent. In the manufacturing line shown in FIG. 2, the boards or panels 22 are supported on support rollers 32 and are compressed by pinch rollers 34, which may be the final step in the manufacture of the particleboards. The pinch rollers 34 may be heated for the final pressing operation of the conventional methods of manufacturing particleboards. The first step in the method of this invention is then applying a thin liquid cementitious coating on a surface of a particleboard having a moisture content of less than about five percent or more preferably less than about two to three percent. In FIG. 2, the cementitious coating material is received from a source 38 into a conventional dam 34 which has an opening 35 at its base applying a controlled volume of liquid cementitious coating over the surface 23 of the engineered particleboard. The direction arrow A indicates the direction of the manufacturing line. As set forth above, various cementitious coatings may be applied to the engineered particleboard including, for example, a refined portland cement in a water carrier which is commonly used by the construction industry. Alternatively, the liquid cementitious coating 40 may be applied to the engineered particleboard by a roller having an absorbent surface or cover saturated with the liquid cementitious coating material similar to a paint roller. The liquid cementitious coating then fills the spaces or interstices between the particles of the particleboard and applies a thin coating over the particles. The preferred thickness of the cementitious coating will depend upon the roughness of the particleboard; however, a thickness of between 0.001 and 0.030 inches is suitable for most applications.

The cementitious coating 40 is then dried on the particleboard either by air drying or the surface of the cementitious coating may be heated and dried by a convection heater or the cementitious coated particleboard may be directed through a conveyor oven for example (not shown) if necessary depending upon the speed of the line. The dried cementitious coating is then abraded as by abrading roller 42. As will be understood by those skilled in the art, the abrading roller 42 is rotated at a speed different from the speed of the line to abrade the thin cementitious coating 28, as shown. Alternatively, the dried cementitious coating may be lightly sanded by a conventional belt sander. The purpose of abrading the cementitious coating is to improve the bond between the polyurethane coating 30 and the cementitious coating and to reduce reading of the surface of the particleboard through the polyurethane coating.

The next step in the polyurethane coating method of this invention is to apply a liquid curable polyurethane coating over the abraded cementitious coating. In the disclosed embodiment of the method of this invention, the polyurethane coating is applied by a sprayer 44 having a spray nozzle 46 which directs a spray 47 of a liquid curable polyurethane over the cementitious coating 28. The sprayer 44 is supported on a transfer rod 48 and the sprayer 44 traverses the cementitious coated particleboard as shown by arrow B. As will be understood by those skilled in the art, the sprayer assembly includes a source of polyurethane 50 which is received through line 52 to the spray head 44. Where a plural component polyurethane is applied over the cementitious coating 28, the source of polyurethane 50 will include separate sources of the isocyanate and blended resin components of the curable polyurethane and the line 52 will comprise two separate lines supplying the components of the polyurethane coating to the mixer (not shown) generally in the spray head 44. Alternative methods of applying the polyurethane coating are described above. A suitable plural component polyurethane coating for the method of this invention is available from ITW Foamseal of Oxford, Mich. under the tradename "V8101."

Finally, the method of this invention includes heating the exposed surface of the polyurethane coating prior to curing to a temperature sufficient to remove the surface imperfections in the coating and simultaneously cure the coating. This is accomplished by heating the surface of the coating rapidly to an elevated temperature, preferably about 180° F. to 220° F., such that the surface imperfections are removed before curing. In the most preferred embodiment of the method of this invention, the surface of the polyurethane coating is heated by sweeping an open flame 53 across the surface, thereby flattening the coating surface, removing the surface imperfections in the coating and simultaneously curing the coating. In the disclosed embodiment, a burner distribution head 54 is mounted above the line which is connected to a source of flammable gas 56 by line 58. The burner manifold 60 is connected to the burner distribution head 54 and the gas is ignited to create a flame 53 which sweeps across the uncured liquid polyurethane. The distribution head 54 is mounted on a transfer rod 62, such that the distribution head 54 and flame 53 traverses or quickly sweeps across the surface of the uncured polyurethane to provide even heating of the surface of the polyurethane coating 30. As set forth above, the precise mechanism of the effect of the flame 53 on the uncured polyurethane is not fully understood; however, it is believed that the sudden increase in temperature either results in a reduction of the surface tension or a decrease in the surface viscosity, increasing the flowability of the surface layer. In any event, this method results in substantial elimination of the bubbles and pinholes, such that the surface is very smooth. The flammable gas may be a natural gas producing an open flame temperature of about 1,200° F., although various flammable gases may be used including, for example, propane.

FIG. 3 is a typical cross-section of a polyurethane coated particleboard, such as an oriented strandboard, produced by the method of this invention. An oriented strandboard includes several layers 20A, 20B, 20C, etc. of wood particles or relatively flat strands which are generally oriented in different directions to provide a composite which is very strong and light in weight. The cementitious coating 28 coats the exposed surfaces of the wood chips or strands 24 as shown in FIG. 1 and fills the spaces or interstices between the particles. The polyurethane coating 30 is firmly bonded to the cementitious coating 28 preferably both chemically and mechanically because the surface of the cementitious layer 28 has been abraded, as described above.

FIG. 4 illustrates an alternative embodiment of the method of this invention, wherein the particleboard panels 22 have a moisture content greater than about five percent. As set forth above, engineered particleboards including oriented strandboards are hydrophilic. Therefore, if the particleboards are exposed to moisture over a period of time, the average moisture content may exceed twenty percent. The isocyanate component of polyurethanes, however, react with water and therefore the moisture content should be reduced to less than five percent or more preferably less than two to three percent before coating with a polyurethane. In FIG. 4, the particleboards 22 are first heated by a conventional radiant heater 66 to reduce the moisture content to the desired level, as described. The remainder of the steps in the method shown in FIG. 4 are, however, identical to the method shown in FIG. 2 and therefore need not be repeated. That is, the first step following drying of the particleboards 22 by radiant heater 66 is the application of a cementitious coating 40 using dam 34. The cementitious coating is then dried and abraded as discussed above. A polyurethane coating is then applied over the abraded cementitious coating and the surface of the polyurethane coating is rapidly heated to remove surface imperfections as also described.

As will be understood, various modifications may be made to the method of forming a smooth polyurethane coating on a surface of an engineered particleboard of this invention within the purview of the appended claims. As set forth above, the method of this invention is particularly, but not exclusively adapted for applying a polyurethane coating on oriented strand boards; however, the method of this invention may also be utilized to coat other engineered particleboards, particularly particleboards which are hydrophilic. Various means may, however, be utilized to reduce the moisture content to the desired level before coating, including convection ovens, etc. The cementitious coating may be any powdered cementitious material including refined portland cement which is mixed with sufficient water or a solvent to make the mixture plastic. The surface of the dried cementitious coating may be abraded in any manner, including sanding. Finally, various polyurethane compositions may be utilized and it is believed that the surface of the uncured polyurethane coating may be rapidly heated by other means although direct exposure to a flame has been found to be the preferred embodiment for removing surface imperfections. Having described the method of this invention, the invention is now claimed, as set forth below.

I claim:

1. A method of forming a smooth polyurethane coating on a surface of an engineered particleboard firmly bonded to said surface, said engineered particle board formed of particles in a resin binder having interstices between said particles, comprising the following steps:

applying a thin liquid cementitious coating on a surface of said engineered particleboard, wherein said particleboard has an average moisture content of less than about five percent, said liquid cementitious coating filling said interstices between said particles and coating said surface of said engineered particleboard;

drying said cementitious coating;

abrading the exposed surface of said cementitious coating;

applying a liquid curable polyurethane coating over said abraded cementitious coating; and heating the exposed surface of said polyurethane coating before curing, thereby flattening and removing surface imperfections in said coating and simultaneously curing said polyurethane coating.

2. The method of forming a polyurethane coating on an engineered particleboard as defined in claim 1, wherein said method includes heating said exposed surface of said liquid polyurethane coating by applying an open flame to said surface, thereby increasing the flowability of said coating.

3. The method of forming a polyurethane coating on an engineered particleboard as defined in claim 1, wherein said method includes heating said engineered particleboard prior to applying said liquid cementitious coating sufficiently to reduce the average moisture content of said engineered particleboard to less than about three percent.

4. The method of forming a polyurethane coating on an engineered particleboard as defined in claim 1, wherein said method includes applying said cementitious coating to said engineered particleboard promptly following the manufacture of said engineered particleboard and before the average moisture content of said engineered particleboard exceeds about three percent.

5. The method of forming a polyurethane coating on an engineered particleboard as defined in claim 1, wherein said method of abrading said cementitious coating comprises sanding the exposed surface of said cementitious coating.

6. The method of forming a polyurethane coating on an engineered particleboard as defined in claim 1, wherein said method includes heating and drying said liquid cementitious coating prior to abrading said surface of said cementitious coating.

7. The method of forming a polyurethane coating on an engineered particleboard as defined in claim 1, wherein said method includes applying said liquid polyurethane coating by spraying liquid curable polyurethane over said abradable cementitious coating.

8. The method of forming a polyurethane coating on an engineered particleboard as defined in claim 1, wherein said method includes applying a thin coating of a refined portland cement suspended in water over said surface of said engineered particleboard.

9. A method of forming a smooth polyurethane coating on a surface of an oriented strand board firmly bonded to said surface of said oriented strand board, said oriented strand board formed of wood particles in a matrix having interstices between said wood particles, comprising the following steps:

applying a thin liquid cementitious coating on a surface of said oriented strand board having a moisture content of less than about three percent, said liquid cementitious coating filling said interstices between said wood particles and coating said surface of said oriented strand board;

drying said cementitious coating;

abrading the exposed surface of said cementitious coating; and applying a liquid curable polyurethane coating over said abraded cementitious coating; and applying an open flame to the exposed surface of said liquid polyurethane coating, thereby flattening and removing surface imperfections in said coating and simultaneously curing said coating.

10. The method of forming a polyurethane coating on an oriented strand board as defined in claim 9 wherein said method includes heating said oriented strand board before applying said liquid cementitious coating on said surface of said oriented strand board.

11. The method of forming a polyurethane coating on an oriented strand board as defined in claim 10, wherein said method includes heating said oriented strand board before applying said thin liquid cementitious coating by radiantly heating the surface of said oriented strand board to reduce the overall moisture content of said oriented strandboard to less than about three percent.

12. The method of forming a polyurethane coating on an oriented strand board as defined in claim 10, wherein said method includes heating the exposed surface of said liquid polyurethane coating by applying an open flame to said surface having a temperature of about 1200° F. or greater for about ten to thirty seconds.

13. The method of forming a polyurethane coating on an oriented strand board as defined in claim 10, wherein said method includes drying said cementitious coating by heating said cementitious coating to a temperature of about 140° F. to 250° F.

14. The method of forming a polyurethane coating on an oriented strand board as defined in claim 10, wherein said method includes heating said oriented strand board prior to applying said cementitious coating sufficient to reduce the average moisture content of said oriented strand board to less than about two percent.

15. The method of forming a polyurethane coating on an oriented strand board as defined in claim 10, wherein said method of abrading said cementitious coating comprises sanding the exposed surface of said cementitious coating.

16. The method of forming a polyurethane coating on an oriented strand board as defined in claim 10, wherein said method includes applying said liquid polyurethane coating on said abraded cementitious coating by spraying liquid curable polyurethane over said abraded cementitious coating.

17. The method of forming a polyurethane coating on an oriented strand board as defined in claim 10, wherein said method includes applying said thin liquid cementitious coating to said oriented strand board by applying a thin coating of refined portland cement in a water carrier.

18. A method of forming a smooth polyurethane coating on a surface of an engineered particleboard wherein said polyurethane coating is firmly bonded on said surface of said engineered particleboard, said engineered particleboard formed of wood fibers suspended in a resin matrix wherein said wood particles are separated by interstices between said wood particles, comprising the following steps:

heating said engineered particleboard applying a thin cementitious coating on a surface of said engineered particleboard wherein said engineered particleboard has an average moisture content of less than about three percent, said liquid cementitious coating filling said interstices between said wood particles and coating said surface of said oriented strand board;

heating and drying said cementitious coating;

abrading the surface of said cementitious coating;

applying a liquid curable polyurethane coating over said abraded cementitious coating over said abraded cementitious coating; and heating the exposed surface of said liquid polyurethane coating by applying an open flame to said surface of said polyurethane coating, thereby flattening and removing surface imperfections in said polyurethane coating and simultaneously curing said polyurethane coating.

19. The method of forming a polyurethane coating on an engineered particleboard as defined in claim 18, wherein said method includes heating and drying said engineered particleboard before applying said liquid cementitious coating to reduce the average moisture content of said oriented strand board to less than about three percent.

20. The method of forming a polyurethane coating on an engineered particleboard as defined in claim 19, wherein said method includes heating and drying said engineered particleboard before applying said liquid cementitious coating by radiantly heating said engineered particleboard.

* * * * *